US005352143A

United States Patent [19]

Brown, III

[11] Patent Number: 5,352,143

[45] Date of Patent: Oct. 4, 1994

[54] AUTOMATED NEON TUBE EVACUATION AND GAS FILLING SYSTEM AND PROCESS

[76] Inventor: Henry A. Brown, III, 104 Dantzler St., St. Matthews, S.C. 29135

[21] Appl. No.: 113,593

[22] Filed: Aug. 27, 1993

[51] Int. Cl.[5] ..... H01J 9/395

[52] U.S. Cl. ..... 445/3; 445/6; 445/72

[58] Field of Search ..... 445/6, 3, 63, 72

[56] References Cited

U.S. PATENT DOCUMENTS

| | | | |
|---|---|---|---|
| 2,992,058 | 7/1961 | Mullan | 445/72 |
| 4,371,224 | 2/1983 | Murphy et al. | 445/72 |
| 5,114,372 | 5/1992 | Fuchs | 445/6 X |

*Primary Examiner*—Kenneth J. Ramsey
*Attorney, Agent, or Firm*—Cort Flint

[57] ABSTRACT

A system and method for automatically evacuating and filling neon tubing is disclosed wherein an electrical controller is provided to automatically control the evacuation and fill cycles. For this purpose, pneumatic actuator valves are utilized in the manifold system to selectively control the flow functions in the process during the evacuation and fill cycles. A bombarder signal is delivered to a bombarder unit by the controller, which generates electrical current through the electrodes of the tubing being processed to heat the tubing. A pressure gauge is placed in the manifold system to sense tube pressure and generate an electrical pressure signal which is transmitted to the electronic controller. A temperature sensor is placed in temperature sensing relation with the tubing to sense the temperature of the tubing and generate an electrical temperature signal also transmitted to the controller. As the tubing heats, the pressure is controlled by opening and closing a pump valve to automatically provide desired pressure conditions in the tubing as it is heated. When the tubing reaches a second temperature, the pump valve is opened to evacuate the tubing. At the same time, the bombarder current is automatically terminated by the controller. The tubing is evacuated until a first pressure is reached. At that time, the controller automatically closes a first pump valve and opens a diffusion pump valve to switch the evacuation process to a diffusion pump which draws down the pressure to about 1 micron or less. After the evacuation process is over, the diffusion pump is closed by the controller. When the tubing cools to a filling temperature, as sensed by the temperature sensor, the controller receives the fill temperature signal, and opens up a gas valve to back fill the tubing until a desired filling pressure is reached.

23 Claims, 5 Drawing Sheets

AUTOMATED NEON TUBE EVACUATION AND GAS FILLING SYSTEM AND PROCESS

BACKGROUND OF THE INVENTION

The invention relates to a system and method for automatically evacuating neon tubes and filling the tubing with a neon gas or gas mixture.

Previously, various pumping systems have been proposed for evacuating and filling neon tubes, such as used in neon signs, with neon and other gas mixtures. Typically, the neon pumping system has included a manifold, a mechanical pressure gauge having a visual display connected to the manifold, and a series of greaseless stopcock valves, which are manually operated, controlling the various flows in the manifold. The stopcock valves typically connect the neon tubes with a vacuum pump assembly, and a source of replenishment gas, such as neon or other gas mixture. Stations for filling neon tubes may be placed on opposing ends of the manifold. There is a system stopcock connected between the manifold and the vacuum pump. A diffusion pump may be connected in a by-pass line with the vacuum pump so as not to be connected in use except after the vacuum has been reduced to a certain level, and it is necessary to achieve an even higher vacuum. Alternatively, a diffusion pump may be connected in a second line, with a second vacuum pump. In use, the system stopcock is opened, and the main stopcock to the vacuum pump is opened simultaneously with turning on the pump. The system is manually operated to control the pressure in the tubes as visually determined from the gauge display, and evacuate the tubes to a desired vacuum whereupon the system stopcock to the vacuum pump is closed. During the evacuation process, an electrical potential is placed across the neon tubes to cause the tubes and gases therein to be heated. The stopcock to the vacuum pump may be opened if the pressure becomes too high in the tube during heating. When the temperature and vacuum conditions inside the tube have reached a desired level the electrical potential is removed from the tubes, and the tubes are allowed to cool. Afterwards, the stopcock to the gas source is opened to backfill the tubes with gas, or gas mixture.

One problem with the prior neon pumping systems is that the manual operation often results in the neon tubes not being filled properly. If the neon tubes are not filled properly, then their life will be reduced, and/or they may not produce the desired lighting effect during their life. The suitability of prior neon pumping systems has been limited to that of small neon shops.

It has also been proposed to manually evacuate neon tubes, and afterwards, to automatically fill the neon tube with a gas. The gas flow is automatically cut off when desired gas-filling settings are reached. The gas transfer is electronically controlled to provide consistent filling specifications each time a tube is processed. However, this does not overcome all the problems associated with manual control, nor control all of the conditions required to process neon tubes to exact specifications, particularly as would be suitable for the mass production of neon tubing and lights.

Accordingly, an object of the invention is to provide a neon evacuation and filling system and method for neon tubes which is automated so that optimal conditions are produced in a tube during evacuation and gas backfilling to provide correct color and long life for the tube and neon sign.

Another object of the invention is to provide an automated system and method for evacuating and filling neon tubes which eliminates human error and performs the steps in the evacuation and filling processes whereby the processing of large numbers of neon tubes may be had according to predetermined specifications to facilitate the mass production of high performance neon tubes.

Another object of the invention is to provide an automated system for evacuating and filling neon tubes which carries out the operational steps of evacuating and filling a tube with neon, or other gas mixture, yet is very simple and reliable to operate.

Yet another object of the invention is to provide a system for evacuating and filling neon tubes in an automated manner which is simple, reliable, and reduces the problems associated with electrical controls of such a system that employs high temperatures and electrical potentials on the tubing during operation.

Still another object of the invention is to provide a fully automated system and method for evacuating and filling neon tubes an electrical controller programmed with operational data of the automatically controls pneumatic actuator valves in response to sensed parameters to carry out evacuation and gas filling of a tube in an optimal manner.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 1A is a schematic diagram of a pneumatic actuator valve for use in the manifold and other connecting lines of an automated system for evacuating and filling neon tubes and the like.

SUMMARY OF THE INVENTION

Figure 1:
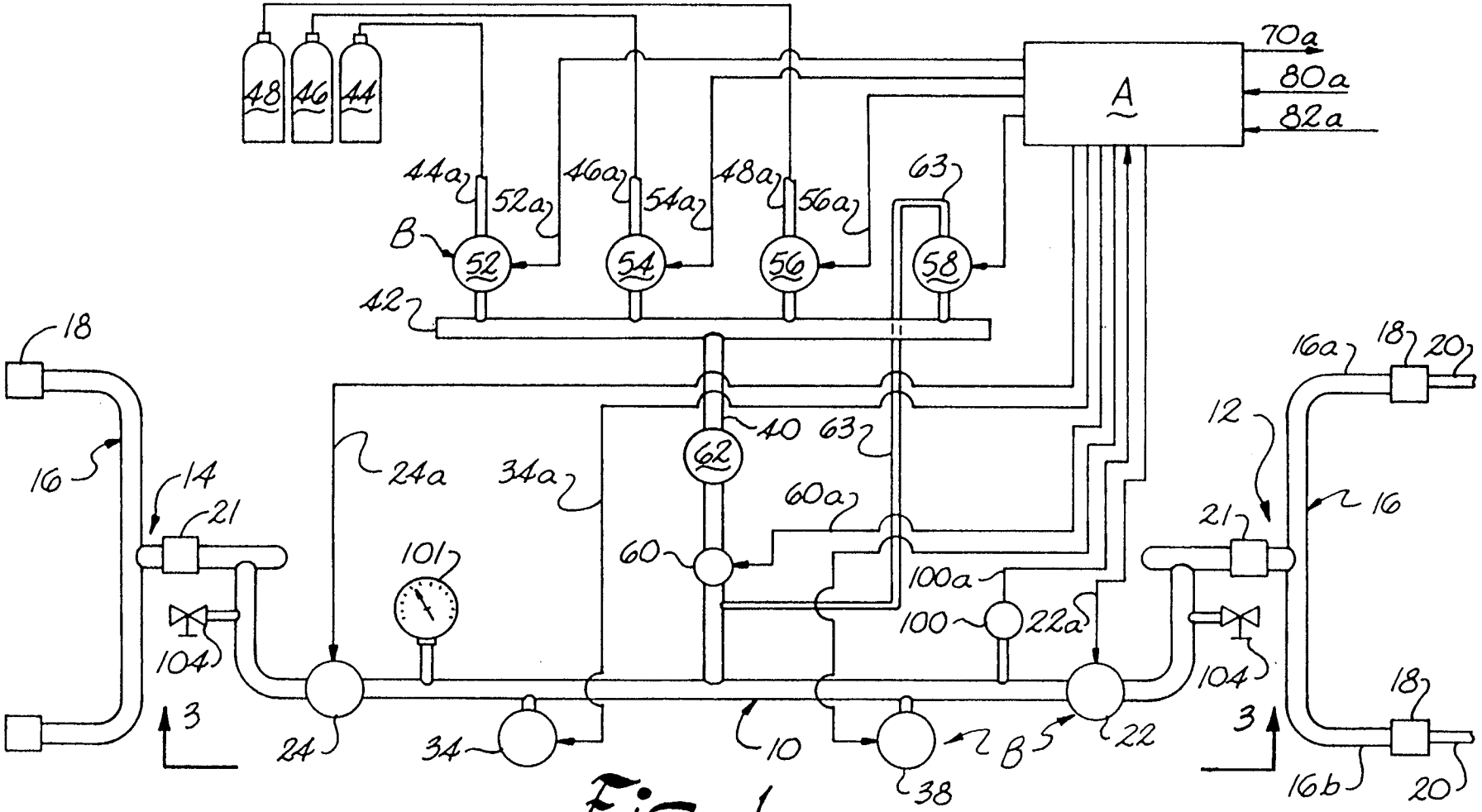
FIG. 1 is a top plain view of a system for automatically evacuating and filling neon tubes and the like according to the invention.
Figure 1A:
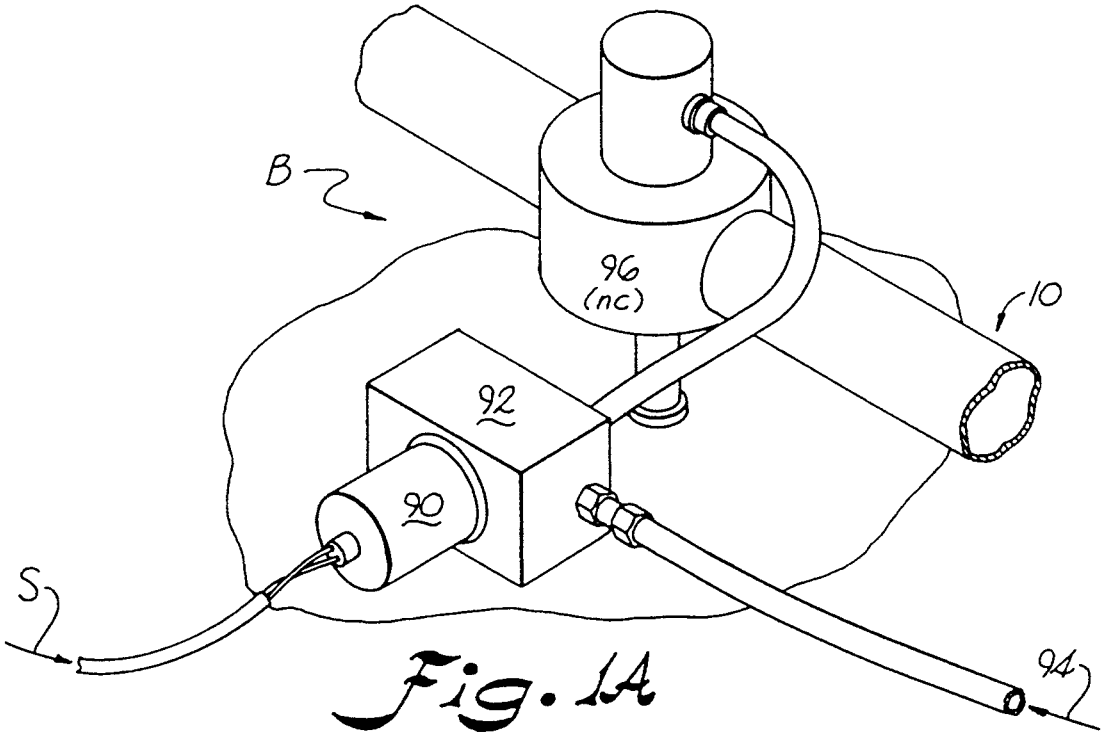

The above objectives are accomplished according to the present invention by providing a system and method for automatically evacuating neon tubing during an evacuation cycle and filling the neon tubing with a gas from at least one gas source during a gas fill cycle. The system comprises a manifold system through which a vacuum is drawn during the evacuation cycle and through which the gas is delivered during a filling cycle. At least one processing station is connected with the manifold system having a fitting for a connection to the neon tubing. At least one first gas valve is provided for controlling the flow of gas from the gas source. At least one main valve is connected in the manifold system for establishing fluid communication between the manifold system and the processing station and neon tubing. At least one vacuum pump is connected to the manifold system for evacuating the neon tubing, and a first pump valve for connecting the pump in fluid communication with the manifold system for evacuating tubing connected to the processing station. An electrical controller containing input data corresponding to operational parameters and values used in the evacuation and fill cycles is utilized. A pressure sensor is connected in the manifold system for generating a pressure signal representing the pressure in the neon tubing, with the pressure signal being transmitted to the controller. A bombarder unit is provided for generating an electrical current and electrical potential across an electrode in the neon tubing for heating the tubing. A temperature sensor is provided for sensing the temperature of the tubing as the tubing is heated by the bombarder current for generating a temperature signal representing the temperature, the temperature signal being input into the controller.

The bombarder unit is controlled by the electronic controller in response to the temperature signals. The controller generates a main valve signal to control the main valve, a pump signal for controlling the first pump valve, a gas valve signal for controlling the gas valve, and a current signal for controlling the bombarder unit and current generated thereby. The controller automatically controls the first pump valve in response to the pressure and temperature signals for maintaining desired pressure conditions in the tubing as the tubing is heated by the bombarder current during the evacuation cycle, and for generating a pump signal to close the pump valve after the evacuation cycle. The controller automatically controls the gas valve during the fill cycle to backfill the evacuated tubing with a desired gas according to predetermined specifications, and, thereafter, the controller closes the gas valve and the main valve.

An optional flush gas valve may be provided to connect a source of flush gas to the manifold system. In this case, the controller generates a flush gas signal in response to reaching a flush gas temperature for controlling the flush gas valve to deliver flush gas into the manifold system, and hence, the tubing. First, the electrical controller automatically closes the first pump valve in response to the flush gas signal. Afterwards, the controller automatically controls opening and closing of the first pump valve after delivery of the flush gas to the tubing to control the pressure conditions in the tubing. The electrical controller also switches off the bombarder current prior to opening the flush gas valve and backfilling the tubing with flush gas, and switches the bombarder current on again after the tubing has been backfills with the flush gas. The electrical controller automatically controls the opening and closing of the pump valve during bombardment of the flush gas to maintain pressure conditions in the tubing between approximately 1 and 2 torr and removes unwanted gases.

Preferably, a second vacuum pump (diffusion) and a second pump valve are connected to the manifold system. The second pump valve for selectively places the processing station and tubing in fluid communication with the diffusion pump which has a higher vacuum pumping capacity than the first pump. The electrical controller automatically controls the first pump valve and the second pump valve to automatically place the second pump in communication with the tubing after prescribed temperatures and pressure signals have been received by the controller.

In the preferred embodiment, a master gas valve is disposed in the manifold system between the first gas valve and the main valve. A metering valve is disposed between the first gas valve and the master gas valve to provide a metered gas flow through the master gas valve to the processing station. The electrical controller automatically controls the first gas valve to dispense gas into a gas manifold upstream of the master gas valve, and controls the master gas valve to deliver metered gas flow to processing station. A by-pass line has a first end connected to the manifold system at an upstream side of the metering valve and a second end connected in the manifold system on a downstream side of the metering valve. A by-pass valve is connected in the by-pass line; and the controller automatically controls the by-pass valve and the first pump valve to automatically purge the gas remaining in the manifold system on the upstream side of the metering valve by directing the gas through the by-pass line, the downstream side of the manifold system, and the vacuum pump. The purging is carried out when a gas is present in the manifold that is different from the gas being introduced.

The main valve, first pump valve, and gas valve, consist of pneumatic actuator valves for controlling a desired flow condition in the manifold system; and the pneumatic actuator valves have valve parts operated by air only disposed in fluid communication with the manifold system. The pneumatic actuator valves each include a pneumatic actuator disposed in fluid communication with the manifold system, an air line for delivering air to the pneumatic actuator, and an electrically controlled valve connected to the air line for controlling the flow of air through the air lines. The electrically controlled valve is controlled by the electrical control signals from the controller.

In the method according to the invention, neon tubing is automatically evacuated during an evacuation cycle and filled with a gas from at least one gas source during a fill cycle. The process comprises sensing the pressure in the manifold system and generating an electrical pressure signal; and sensing the temperature in the neon tubing and generating an electrical temperature signal representing the temperature. An electrical controller is provided for automatically controlling the process which receives the electrical pressure and temperature signals automatically. The bombarder current delivered to the tubing during the evacuation cycle to heat the tubing is controlled, and increased in response to the temperature signal reaching a first temperature during the evacuation cycle. The first pump valve is controlled continuously to open and close the first pump valve during the evacuation cycle in response to the pressure signal as the neon tubing is heated to maintain the pressure in the tubing within prescribed conditions. The first pump valve is automatically opened in response to the temperature signal reaching a second temperature greater than the first temperature to evacuate the tubing. Afterwards, the pump valve is automatically closed in response to the pressure signal reaching a first pressure. The gas valve is automatically opened during the fill cycle in response to the pressure signal reaching a second pressure, and the temperature signal reaching a third temperature less than the second temperature, to fill the neon tubing with gas. The gas valve is automatically closed when the pressure of the gas in the tubing has reach a desired filling pressure. The main valve is closed following closure of the gas valve.

In the method, the second pump valve selectively connects the diffusion pump in fluid communication with the manifold system, and automatically opens the diffusion pump valve in response to the first pressure after the first and second temperatures have been reached. The second pump valve is closed in response to the controller receiving the second pressure signal and gas fill temperature signal, before the gas valve is open.

The method contemplates purging of the manifold system of unwanted gases prior to opening the gas valve and backfilling the tubing with the gas.

DETAILED DESCRIPTION OF A PREFERRED EMBODIMENT

Figure 3:
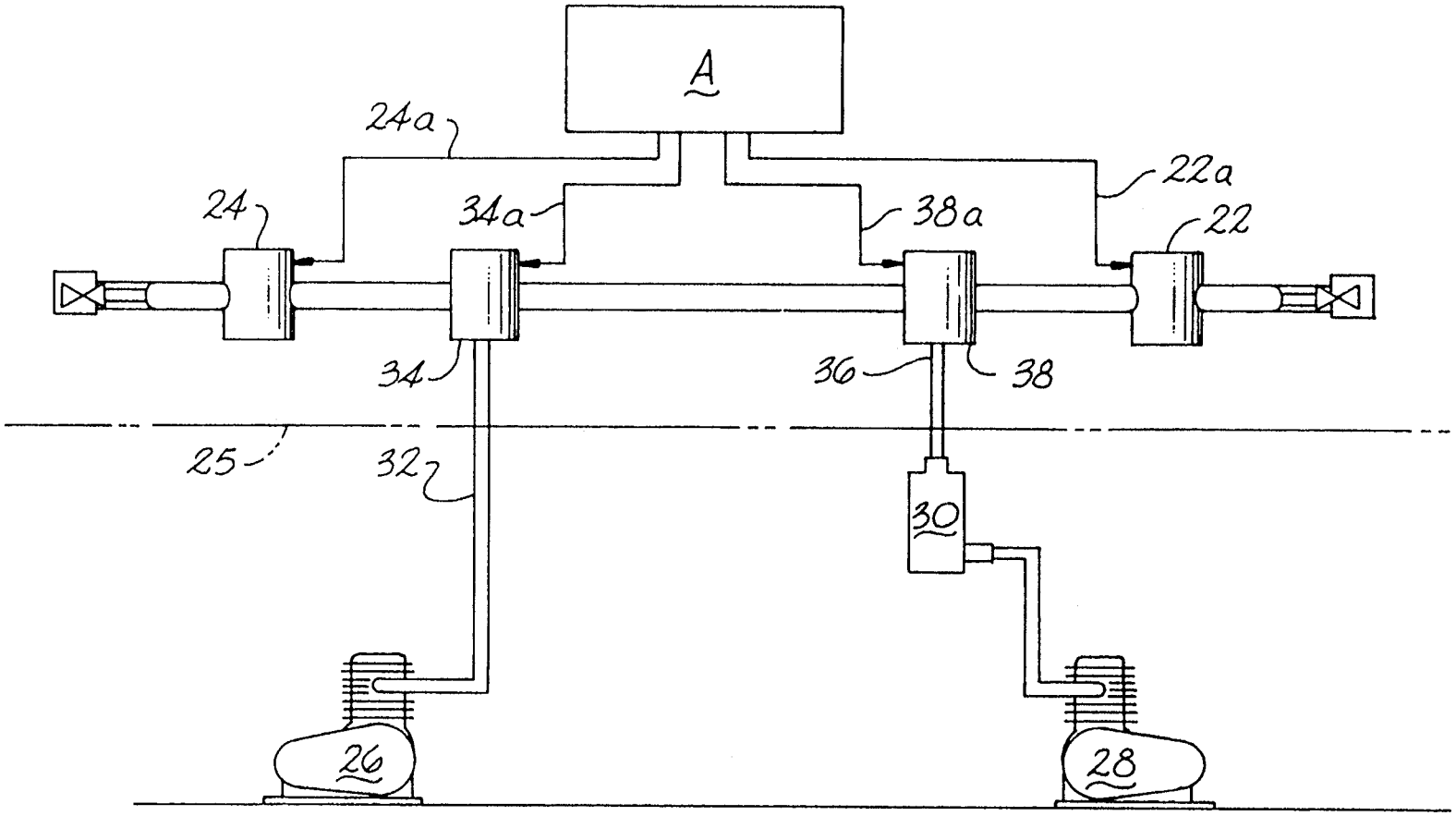
FIG. 3 is a front elevation of a system for automatically evacuating and filling neon tubes according to the invention.
Figure 4:
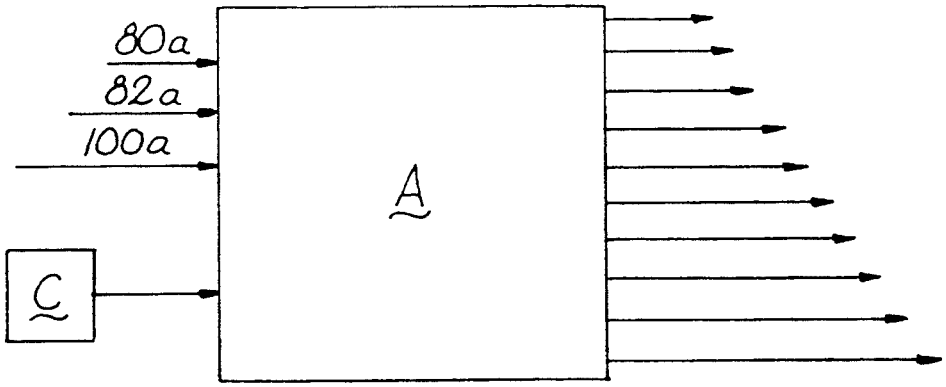
FIG. 4 is a schematic illustration of an electrical controller for an automated system for evacuating and filling neon tubes showing the various inputs and outputs for the various controlled parameters and sensed parameters.

Referring in more detail now to the drawings, FIG. 1 illustrates an automatic system and method for automatically evacuating and filling neon tubes with a gas or gas mixture wherein the system comprises a manifold system, designated generally as M, which includes a manifold 10 having right and left processing stations to which neon tubes are attached, designated generally as 12 and 14, respectively. Manifold 10 is preferably constructed from glass, although other materials such as stainless steel may also be utilized. At station 12 there is a forked arm 16 having a pair of arms 16*a* and 16*b* which carry the compression fittings 18 for receiving the reduced diameter of neon tubing 20 in a generally air tight manner, as can best be seen in FIG. 3. A compression fitting 21 may also connect fork 16 to manifold 10. Left station 14 includes an identical forked arm 16 secured in fluid communication to manifold 10 by means of a compression fitting 21. In this manner, time may be saved by processing two different sets of neon tubing 20 together. Not all the operations on both sets of tubings may be carried out simultaneous, it is possible that certain operations may be carried out with neon tubes at station 12 while certain other operations are being carried out with neon tubes at station 14. There is a first main valve 22 connected in manifold 10 which controls fluid communication with station 12, and a second main valve 24 which controls communication with the second or left station 14.

Disposed below a working surface 25, such as a table and the like, is a first vacuum pump 26 and a second vacuum pump 28. A diffusion pump 30 is disposed in series with second vacuum pump 28. First vacuum pump 26 is connected to manifold 10 by means of a glass conduit 32 in which is connected a first pump valve 34. Similarly, second vacuum pump 28 and diffusion pump 30 are connected to manifold 10 by means of a glass conduit 36 and a second pump valve 38. Valves 34 and 38 control fluid communication between respective conduits 32, 36 to manifold 10, and open fluid communication is always provided along the manifold 10, i.e. closed valve 38 does not block communication between processing station 12 and pump when valve 34 is open. First vacuum pump 26, is commonly referred to as a roughing pump since it is utilized to reduce the pressure or achieve a vacuum in the neon tubes at a certain level. Afterwards second vacuum pump 28 is utilized to achieve a higher vacuum, i.e. one micron of pressure or less. Suitable vacuum pumps and diffusion pumps are available from Transco Inc. of Columbia, S.C.

Included in manifold system M is a T-shaped manifold having a stem 40, connected to manifold 10, and an arm 142. Connected to arm 42 are a plurality of gas sources 44, 46, and 48. Each gas source is connected to the T-manifold by suitable glass conduits 44*a*–48*a*. Connected in the respective glass conduits are a plurality of automated valves 52, 54, and 56. A by-pass valve 58 is connected to manifold 42 and a by-pass line 63. Connected in stem 40 is an automatically controlled master gas valve 60 and a manual metering valve (stopcock) 62. Manually operated valve 62 is a metering valve which meters the flow of gas through the manifold when one of the gas valves 52–56 is opened. The gas sources 44–48 may be any suitable gas sources depending on the application being made and the neon tubes being processed. For example, gas source 44 may be an argon gas, gas source 46 may be a neon gas, gas source 48 may be a nitrogen flush gas. Valves 52–56 are selectively opened to dispense a gas into the T-manifold upstream of master valve 60 which, being closed, retains the gas in the T-manifold. The gas is dispensed from the T-manifold through metering valve 62 by opening master valve 60. Otherwise, merely opening and closing a gas valve 52–56 would allow too much gas into the system. The metering orifice of valve 62 is adjustable, but remains fixed once set.

By-pass line 63 is connected between T-manifold 40 and the downstream side of automatic valve 60 hence manifold 10, as can best be seen in FIG. 1. The by-pass enables purging of the T-manifold on the upstream side of master gas valve 60 when automatic valves 58 and 34 are open. This happens to purge the T-manifold of flush gas before a back fill cycle of neon and/or gas; and to purge the T-manifold of neon and/or argon before a flush gas is introduced into the tubing. This keeps either gas from being contaminated with the other.

Figure 2A:
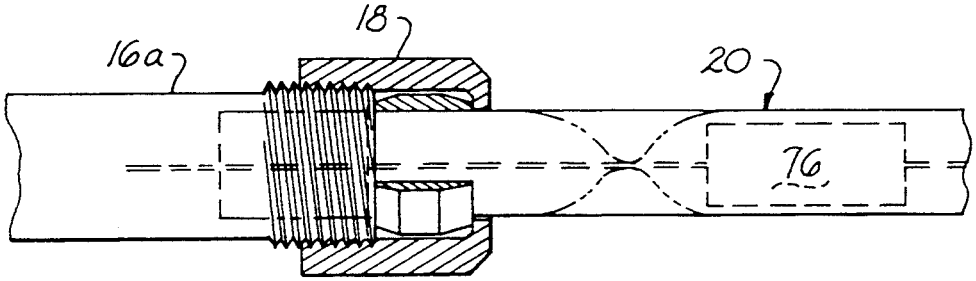
FIG. 2A is an enlarged view of a section showing a compression fitting for connecting tubing being processed.
Figure 2:
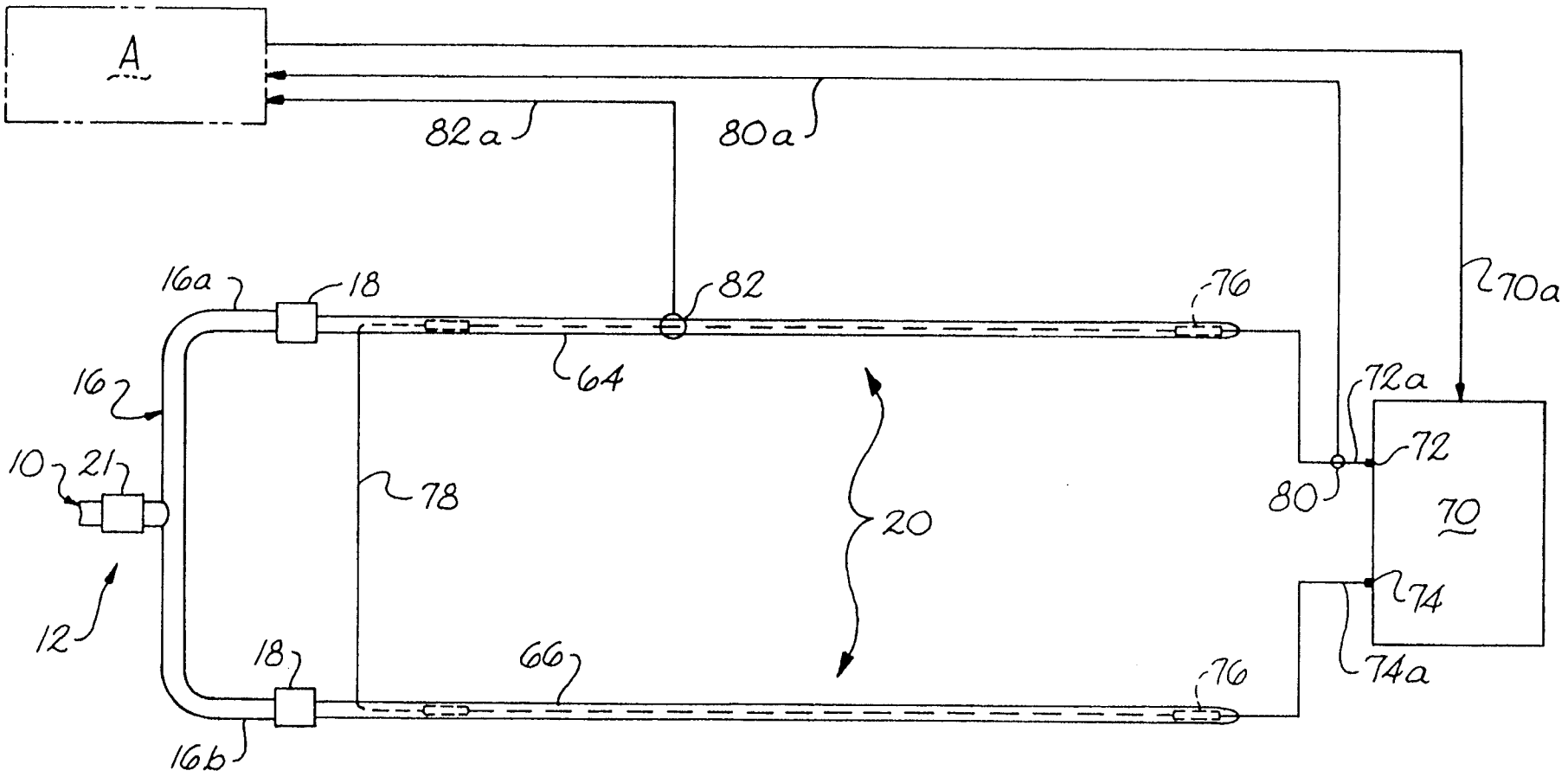
FIG. 2 is a schematic illustration showing a pair of neon tubes connected to a system for automatically evacuating and filling a tube with neon or other gas according to the invention wherein the tubes are connected to a bombarder.

Referring now to FIG. 2, neon tubes 64 and 66 are shown connected to processing station 12 for processing. Neon tube 64 is connected to arm 16*a* and tube 66 is connected to arm 16*b* of fork arm 16 at station 12. This connection is made by compression fittings 18. A bombarder 70 is provided having a pair of outputs 72 and 74 which are connected to the electrodes, designated schematically as 76 of the neon tubes, in a conventional manner, as can best be seen in FIG. 3. The bombarder 70 places an electrical potential across the neon tubes from the output 72 and 74, and for this purpose, there is a connector wire 78 completing the circuit between the bombarder and the tubes. Preferably, there is a current sensor 80 connected in one of the electrical leads, such as 72*a* for sensing the current flowing through the neon tubes, and sending a current signal 80*a* representing the bombardment current. Also, a conventional heat sensor 82 is preferably disposed in or about one of the neon tubes to sense the temperature of the neon tube or tubes and delivering a temperature signal 82*a* representing the temperature to which the tube is heated.

An electrical controller A is illustrated for controlling the system and method. The controller may be any suitable programmed controller or personal computer programmed to carry out the invention, as is well within the preview of one skilled in the automatic control art, having been taught the features and expedients of the present invention. Accordingly, the terms controllers and computer are used interchangeably to mean any electrical control device used to accomplish automatic control of the invention. In order to facilitate electrical control, it has been found an advantage to provide the automatically controlled valves of the present invention (22, 24, 36, 52–58 and 60) in the form of pneumatic actuator valves, i.e. the valve part disposed directly in a passage in fluid communication with the manifold is air actuated. Electrical valves, which are grounded, may short the electrical potential generated by bombarder 70 through a valve to ground, and burn the valve out, or cause other damage or problems. Accordingly, in the illustrated embodiment pneumatic actuator valves B are utilized. As can best be seen in FIG. 5, one simplified embodiment of a suitable pneumatically operated valve B includes an electrical solenoid 90 which is operated by an electrical control signal S, to be described more fully hereinafter. Solenoid valve 90 operates an air valve 92 which is connected to a suitable air source 94. Air valve 92 controls admission of air via line 95 to selectively open and close a valve 96 disposed in the manifold (10, 40,42) to control the desired fluid flow function being controlled. One suitable pneumatic actuator valve assembly, producing the above described valves and valving functions, is manufactured by Edwards High Vacuum International of West Sussex, England. Air actuator valve 96 a model designation as PV-10PKAD. Air valve 92 may be a solenoid operated air valve manufactured by Fluid Automation Systems, having a model designation number 6-311-ED02-30, also available from Edwards High Vacuum International. Solenoid 90 is preferably a low voltage DC unit, such as a 24 volt DC unit, having a model designation number HO-62-00-124 available from the Edwards High Vacuum International. Accordingly, right and left main valves 22 and 24; first and second pump valves 34 and 38; gas valves 52–58; and master gas valve 60 are all pneumatic actuator valves B described above.

The various sensors provided for automatic control of the process include a pressure gauge 100 connected to manifold 10 which may be any suitable pressure gauge and sensor, such as that manufactured by Edwards High Vacuum International of West Sussex, England under the model designation number APG-L-NW16. This type gauge is commonly referred to as a PIRANI gauge. Pressure gauge 100 generates a signal 100*a* representative of the pressure or vacuum in the main system, and neon tubes 64 and 66. Temperature sensor 82 may be suitable temperature sensor which generates a signal 82*a*. Current sensor 80 likewise generates a signal 80*a*. Pressure signal 100*a*, temperature signal 82*a*, and current sensor 80*a* are delivered to a controller or computer A which has already been programmed with operational data C. A mechanical pressure gauge 101 with a display scale may be provided as a back-up.

Data C is input into the controller in the form of tabular data. In one embodiment of the invention look up Tables I, II, and III may be utilized. Table I includes the starting current and final current ranges for the bombarder as a function of electrode type. The model numbers for the electrode of the neon tube being filled is input into the controller at the beginning of the process by the operator. Data C may also include a sub-table (not shown) to determine a specific starting and final bombarder current, within the starting and final current ranges of Table I, to be used during the evacuation cycle, as a function of the tubing length. During the process, the starting and final currents are automatically looked up. The evacuation cycle switches from the starting current to the final current at about 170°. Table II may include the pressures in torr that correspond to various output voltages of pressure gauge 100. Accordingly, the controller translates signal (voltage) 100 a received from the pressure gauge automatically into pressure according to Table II. Table III represents pressure of the gas with which the neon tube is being filled as a function of the tube diameter. Before the process begins, the tube diameter is input into the controller by the operator. During the process, filling cycle is terminated upon reaching the filling pressure corresponding to the tube diameter.

TABLE I

| MODEL (ELECTRODE) | STARTING CURRENT | FINAL CURRENT |
|---|---|---|
| 10/20 | 180–240 | 300–400 |
| 12/25 | 210–270 | 350–450 |
| 12/30 | 270–330 | 450–550 |
| 12/30C | 270–330 | 450–550 |
| 13/25 | 210–270 | 350–450 |
| 13/30 | 270–330 | 450–550 |
| 15/25 | 210–270 | 350–450 |
| 15/30C | 270–330 | 450–550 |
| 15/50 | 330–390 | 550–650 |
| 15/50C | 330–390 | 550–650 |
| 18/60C | 360–420 | 600–700 |
| 18/100 | 420–480 | 700–800 |
| 18/100C | 420–480 | 700–800 |
| 18/120 | 480–540 | 800–900 |
| 18/120C | 480–540 | 800–900 |
| 18/250C | 540–600 | 900–1000 |

TABLE II

Pressure characteristic APG-L-NW16 (PIRANI gauge) dry air, nitrogen

| Output Voltage | Pressure (torr) | Output Voltage | Pressure (torr) |
|---|---|---|---|
| 2.00 | vacuum | 7.60 | 1.05 |
| 2.05 | $6.20 \times 10^{-5}$ | 7.80 | 1.25 |
| | | 8.00 | 1.44 |
| | | 8.20 | 1.79 |
| 2.01 | $1.70 \times 10^{-4}$ | 8.40 | 2.21 |
| 2.20 | $3.75 \times 10^{-4}$ | 8.60 | 2.63 |
| 2.40 | $8.10 \times 10^{-4}$ | | |
| 2.60 | $1.26 \times 10^{-3}$ | 8.80 | 3.13 |
| 2.80 | $1.95 \times 10^{-3}$ | 9.00 | 4.05 |
| 3.00 | $2.88 \times 10^{-3}$ | 9.20 | 5.30 |
| 3.20 | $3.86 \times 10^{-3}$ | 9.40 | 7.27 |
| 3.40 | $5.15 \times 10^{-3}$ | 9.50 | 9.6 |
| 3.60 | $7.88 \times 10^{-3}$ | | |
| 3.80 | $1.17 \times 10-2$ | 9.60 | $1.24 \times 10^{+1}$ |
| 4.00 | $1.58 \times 10^{-2}$ | 9.70 | $1.55 \times 10^{+1}$ |
| 4.20 | $2.08 \times 10^{-2}$ | 9.80 | $2.54 \times 10^{+1}$ |
| 4.40 | $2.59 \times 10^{-2}$ | 9.90 | $4.74 \times 10^{+1}$ |
| 4.60 | $3.12 \times 10^{-2}$ | | |
| 4.80 | $3.78 \times 10^{-2}$ | | |
| 5.00 | $4.44 \times 10^{-2}$ | | |
| 5.20 | $6.56 \times 10^{-2}$ | | |
| 5.40 | $9.53 \times 10^{-1}$ | | |
| 5.60 | $1.28 \times 10^{-1}$ | 9.95 | $1.08 \times 10^{+2}$ |
| 5.80 | $1.67 \times 10^{-1}$ | 10.0 | $7.50 \times 10+2$ |
| 6.00 | $2.18 \times 10^{-1}$ | | |
| 6.20 | $2.68 \times 10^{-1}$ | | |
| 6.40 | $3.26 \times 10^{-1}$ | | |
| 6.60 | $4.00 \times 10^{-1}$ | | |
| 6.80 | $4.80 \times 10^{-1}$ | | |
| 7.00 | $5.75 \times 10^{-1}$ | | |
| 7.20 | $6.92 \times 10^{-1}$ | | |

TABLE II-continued

| Pressure characteristic APG-L-NW16 (PIRANI gauge) dry air, nitrogen | | | |
|---|---|---|---|
| Output Voltage | Pressure (torr) | Output Voltage | Pressure (torr) |
| 7.40 | $8.55 \times 10^{-1}$ | | |

TABLE III

| Process Operation | | |
|---|---|---|
| | RECOMMENDED GAS FILLING PRESSURE | |
| TUBE DIAMETER | NEON | ARGON |
| 7 | 18 | 18 |
| 8 | 17 | 17 |
| 9 | 15 | 15 |
| 10 | 13 | 13 |
| 11 | 12 | 12 |
| 12 | 11 | 11 |
| 13 | 10 | 10 |
| 14 | 10 | 10 |
| 15 | 9 | 9 |
| 18 | 8 | 8 |
| 20 | 7½ | 7½ |
| 22 | 7 | 7 |
| 25 | 6 | 6 |

Warm Up

To begin the evacuation and fill cycles, electrical power to the system and controller A is turned on. The first, rough pump 26 is turned on and the second pump 28 is turned on. The warm-up cycle has a duration of ten to fifteen minutes. During this time, the action of vacuum gauge 100 is ascertained within a certain range ($10^{-3}/10^{-4}$).

Set-Up

First, the process mode is selected as either automatic or manual. Automatic is selected if the process is to be repeated without changing the set-up values. Manual is selected if the tubing being processed is changed out and different set-up values are required. The set-up values are as follows:

(1) The number of units to be process is specified. Two neon tube units may be processed for each bombarder.

(2) The type of filling gas is selected, e.g. 100% neon, 75% neon/25% argon, helium, or other mixture.

(3) The length of the units to be processed is input. Typically, the lengths of the tubing will be one to four feet, five to eight feet, nine to twelve feet, and thirteen feet and larger. This establishes the starting current temperature and pressure in the tubing during the evacuation cycle. The longer the footage of the tubing, the less is the starting pressure and current signal.

(4) The information of whether the glass tubing is clear (250° C.), coated (225° C.), or colored (200° C.) is input for purposes of selecting the temperature to which the tubing is heated.

(5) The diameter of the glass tubing is specified in millimeters which determines the gas filling pressure according to Table III.

(6) The model electrode is input which determines the starting and final currents according to Table I.

To initiate a process cycle, the manual vent stopcock 104 is closed and the tubing units are attached to the compression fittings 18 at one or more of the processing stations 12, 14. At this point, the operator actuates a key on the controller or a start button on the controller, whichever type of automatic control is utilized. After the process, described more fully below, is completed, the controller automatically moves to the next tubing to be processed skipping set-up values (1)–(6) if the tubing is the same. If manual was selected at the beginning of the process, then the operator will have to reestablish the above set-up values.

For purposes of describing the automatic evacuation and fill cycles, right processing station 12 will be referred to.

Evacuation Cycle

Signal **22*a* opens main valve 22 which allows the pressure to fall as the neon tubes 64,66 are evacuated. The rough pump 26 is operating at this time, and pump valve 34 is open by signal 34*a*. The remaining valves in the system are closed. The vacuum pressure in the tubes are drawn down to a range between 2 and 5 torr. The pressure is sensed in manifold 10 by active pressure gauge 100. The pressure sensor signal 100*a* is sent to controller A. The controller has already been programmed with data C which is based on the number of units, diameter of the tubes, length, etc. Based on this information, when a pressure signal 100*a* is received by the controller in the range specified, the controller will send a signal 34*a* to close pump valve 34. At the same time, a current signal 70*a* will be sent to bombarder 70 by the controller to establish a desired bombarder current in order to strike an arc and light up the tubing 64, 66. If the tubes do not light up, it may be necessary to draw down the pressure more and try again. This is done in the same manner as described above. Current signals 70*a*** are determined by look-up Table I.

Once, the tubes are lighted, the pressure in the tubes will increase as the tubes are heated. Whenever the pressure builds to 3 torr, pump valve 34 is opened and the back pressure is reduced to 1 torr. The pressure is continually sensed by pressure sensor 100 during this time, pressure signal **100*a* is generated, and valve 34** controlled to maintain pressure in a desired range (e.g. 1–3 torr).

In an optional step, when tubes 64, 66 reach a 100° C. (flush gas temperature), the controller will then send a signal **70*a* to switch the current off, and a signal 34*a* to open pump valve 34, and evacuate tubes 64, 66. The vacuum pressure is reduced to 20 microns, or for a 30 seconds (maximum). Once the pressure reaches 20 microns, as determined by the controller in response to signal 100*a*, the controller will send a signal 34*a* to close pump valve 34. The controller will then send a signal 34*a*, 56*a* to the nitrogen and flush gas connector valve 54, 56 to open the valves. This pumps a prescribed amount (2 torr) of this flush gas into manifold 10 and neon tubes 64, 66. Once that is completed, then the controller will switch the bombarder current back on where it was, and will continue the heating of tubes 64, 66. Again, as a continuation, the controller will continually monitor the pressure via sensor 100, and if a pressure build up of 3 torr is sensed, send a signal 34*a* will be sent to open pump valve 34** and reduce the pressure to 1 torr. The flush gas cycle is optional. However, the flush gas removes contamination that can be evacuated and fills the tubes with a neutral gas or a flush gas. This controls impurities in the tube. If the impurities are not removed at that point, the impurities have to be removed at the final step by using a high vacuum. As the tube heats, the gas mixture becomes less flush gas and more water molecules, more carbon dioxide gas, so the flush gas is diluted with contaminants. If nitrogen or other flush gas is not used, only water vapor and all carbon dioxide will exist at that point. The nitrogen is a dry gas, and not as adverse as water vapor. The by-products of heating the tube are water vapor and carbon dioxide, which are taken out.

Neon tubes 64, 66 continue to be heated by bombarder 70. As the tube temperature reaches 150° C. to 170° C. ("first temperature"), as determined by temperature signal 82*a*, current signal 70*a* is increased by the controller in accordance with the program data (Table I). Current sensor signal 80*a* feeds back to the controller to continually provide a check on the current level. At this point, the pressure, which is continuously being monitored by the sensor 100, is reduced to 1 torr. The pressure is maintained between 1 and 3 torr at this point, to remove unwanted gases. To accomplish this pressure reduction, the controller sends a signal 34*a* to pump valve 34 to open it momentarily. In an average filling sequence, it may be necessary to open pump valve 34 three or four times over a two minute period.

When the tube temperature reaches 225° to 250° C. ("second temperature"), as determined by temperature signal 82*a*, and the electrodes 76 inside the neon tubes are glowing bright orange or red, bombarder current is switched off by the controller, and pump valve 34 is fully opened by signal 34*a* to allow the neon tubes to evacuate. At approximately 200 to 500 microns of pressure ("first pressure"), as sensed by Pirani sensor 100, and after the second temperature is reached, the controller closes pump valve 34 and opens second pump valve 38 by means of signals 34*a*, 38*a*. This swaps the rough vacuum pump 26 for the secondary vacuum pump 28 and diffusion pump 30 which increases the pumping capacity. The diffusion pump is a fairly delicate instrument and is used when the overall vacuum and the level of contamination is controlled carefully. The rough pump is used to evacuate a large proportion of the contaminants released throughout the process. At the crossover point of 200 to 500 microns, the final level of contaminants and impurities are in very small quantities. This reduces the contamination of the oil in the diffusion pump, and the level of maintenance required on the diffusion pump. The evacuation must occur before the tubes cool to the filling temperature. For example, a diffusion pump may evacuate at a rate of 50 liters per second, or 3000 liters per minute, whereas rough pump 26 evacuates at a rate of 200 liters per minute, so there is a large volume difference between the two pumps. When a pressure of one micron, or less, is reached, the pump value 38 is closed.

Fill Cycle

When neon tubes 64, 66 cool to a proper filling temperature, e.g. 100° ("backfill temperature") and the vacuum is 1 micron less ("second pressure"), the neon tubes may be backfilled with a selected gas. For example, the selected gas may be neon or an argon gas mix. For the neon gas, the neon tubes must be cooled to approximately 100° C. For an argon gas mix, the tubes must be cooled to approximately 80° C. There are a plurality of gas sources; 44 for argon gas, a neon gas source 46, and a nitrogen, flush gas source 48, which have already been described. Depending upon the preselected gas, the controller opens the appropriate valve 52–56 at this time (via signals 52*a*–56*a*), and begins backfilling the neon tubes. For example, if neon gas has been preselected, a signal 54*a* is sent to valve 54 opening this valve so that neon gas from this source is delivered through the T-manifold 40, and through the manually set gas metering valve 62. Based on the data table programmed in the controller, the controller closes valve 54 in response to receiving a pressure signal 100*a* corresponding to the desired pressure (Table III) of the back filled gas. A signal 22*a* then closes right main valve 22 terminating the process. A gas torch is used to seal off the ends of the neon tubes whereupon they may be removed and the process completed.

Thus, it can be seen that an advantageous construction can be had according to the invention for a system and method that automatically evacuates and fills neon tubing according to exact specifications to provide neon lights having accurate color and long life in mass manufacture.

While a preferred embodiment of the invention has been described using specific terms, such description is for illustrative purposes only, and it is to be understood that changes and variations may be made without departing from the spirit or scope of the following claims.

What is claimed is:

1. A system for automatically evacuating neon tubing during an evacuation cycle and filling the neon tubing with a gas from at least one gas source during a gas fill cycle comprising:

a manifold system through which a vacuum is drawn during said evacuation cycle and through which said gas is delivered during a filling cycle;

at least one processing station connected with said manifold system having a fitting for connection to said neon tubing;

at least a first gas valve for controlling the flow of gas from said gas source;

at least one main valve connected in said manifold system for establishing fluid communication between said manifold system and said processing station and neon tubing;

at least one vacuum pump connected to said manifold system for evacuating said neon tubing, and a first pump valve for connecting said pump in fluid communication with said manifold system for evacuating tubing connected to said processing station;

an electrical controller containing input data corresponding to operational parameters and values utilized during said evacuation and fill cycles;

a pressure sensor connected in said manifold system for generating a pressure signal representing the pressure in said neon tubing, said pressure signal being transmitted to said controller;

a bombarder unit for generating an electrical current and electrical potential across an electrode in said neon tubing for heating said tubing;

a temperature sensor sensing the temperature of said tubing as said tubing is heated by said bombarder current for generating a temperature signal representing said temperature, said temperature signal being input into said controller, and said bombarder unit being controlled by said controller in response to said temperature signals;

said controller generating a main valve signal to control said main valve, a pump signal for controlling said first pump valve, a gas valve signal for controlling said gas valve, and a current signal for controlling said bombarder unit and current generated thereby;

said controller automatically generating said pump signal and controlling said first pump valve in response to said pressure signals for providing desired pressure conditions in said tubing as said tubing is heated by said bombarder current during said evacuation cycle, and said controller opening said pump valve to evacuate said tubing in response to said temperature signal during said evacuation cycle and closing said pump valve in response to said pressure signal after said evacuation cycle; and said controller automatically controlling said gas valve during said fill cycle to admit gas to backfill said evacuated tubing with a desired gas according to predetermined specifications, and, thereafter, said controller closing said gas valve and said main valve.

2. The system of claim 1 including a flush gas valve connecting a source of flush gas to said manifold system, and said controller generating a flush gas signal in response to reaching a flush gas temperature for controlling said flush gas valve to deliver flush gas into said manifold system.

3. The system of claim 2 wherein said electrical controller automatically closes said first pump valve in response to said flush gas signal, and automatically controls opening and closing of said first pump valve after delivery of said flush gas to said tubing to control the pressure conditions in said tubing.

4. The system of claim 3 wherein said electrical controller switches off said bombarder current prior to opening said flush gas valve and backfilling said tubing with flush gas, and switches said bombarder current on again after said tubing has been backfilled with said flush gas.

5. The system of claim 4 wherein said electrical controller automatically controls the opening and closing of said pump valve during bombardment of said flush gas to maintain pressure conditions in said tubing between approximately 1 and 2 torr and remove unwanted gases.

6. The system of claim 1 including a second vacuum pump, and a second pump valve connecting said second pump to said manifold system for selectively placing said processing station and tubing in fluid communication with said second pump, said second pump having a higher vacuum pumping capacity than said first pump; and said electrical controller automatically controlling said first pump valve and said second pump valve to automatically place said second pump in communication with said tubing after predetermined temperatures and pressure signals have ben received by said controller to reduce said vacuum pressure further in said tubing during said evacuation cycle.

7. The system of claim 1 wherein said electrical controller automatically increases said bombarder current upon receiving a prescribed temperature signal.

8. The system of claim 1 including:

a master gas valve disposed in said manifold system between said first gas valve and said main valve;

a metering valve disposed between said first gas valve and said master gas valve to provide a metered gas flow through said master gas valve to said processing station; and said electrical controller automatically controlling said first gas valve to dispense gas into said manifold system upstream of said metering valve, and controlling said master gas valve to deliver said metered gas flow to said processing station.

9. The system of claim 8 including:

a by-pass line having a first end connected to said manifold system at an upstream side of said metering valve and a second end connected in said manifold system on a downstream side of said metering valve;

a by-pass valve connected in said by-pass line; and said controller automatically controlling said by-pass valve and said first pump valve to automatically purge said gas remaining said manifold system on said upstream side of said metering valve by directing said gas through said by-pass line, said downstream side of said manifold system, and said vacuum pump.

10. The system of claim 1 wherein said main valve, first pump valve, and gas valve, consist of pneumatic actuator valves for controlling a desired flow condition in said manifold system; and said pneumatic actuator valves having valve parts operated by air only disposed in fluid communication with said manifold system.

11. An automatic system for evacuating neon tubing during an evacuation cycle and filling said neon tubing with a gas during a filling cycle, said system having a manifold system; at least one vacuum pump connected to said manifold system by means of a first pump valve; a neon tube connector connected to said manifold system by means of a main valve; at least one source of gas connected to said manifold system by means of a gas valve; a bombarder for generating an electrical bombarder current for heating said tubing; wherein said system comprises said pump valve, main valve, gas valve, consisting of pneumatic actuator valves disposed in said manifold system; a pressure sensor for sensing pressure in said tubing and generating a pressure signal; a temperature sensor for sensing a temperature within said tubing and generating a temperature signal; and an electrical controller for generating electrical control signals for controlling said pneumatic actuator valves and bombarder current in response to said pressure and temperature signals.

12. The system of claim 11 wherein said pneumatic actuator valves each include an actuator disposed in fluid communication with said manifold system, an air line for delivering air to said pneumatic actuator valve, and an electrically controlled valve connected to said air line for controlling the flow of air through said air lines wherein said electrically controlled valve is controlled by said electrical control signals from said controller.

13. The system of claim 12 including a master gas valve connected in said manifold system downstream of said gas valve;

a metering valve connected in said manifold system between said gas valve and said master gas valve for metering the flow of said gas through said manifold system to said tubing;

said controller controlling said gas valve to introduce an amount of gas into said manifold system upstream of said master gas valve; and said controller controlling said master gas valve to deliver a metered flow of said gas to said tubing.

14. The system of claim 13 including a by-pass line having one end connected to said manifold system upstream of said metering valve and a second end connected to said manifold system downstream of said master gas valve;

a by-pass valve for controlling flow through said by-pass line; and said controller controlling said by-pass valve and said first pump to purge said manifold system upstream of said metering valve from unwanted gases when said by-pass valve and pump valve are open.

15. The system of claim 14 wherein said controller opens said by-pass and pump valves prior to filling said neon tubing with a different gas than presently exists in said manifold system upstream of said metering valve.

16. A process for automatically controlling a system which evacuates neon tubing during an evacuation cycle and fills said neon tubing with a gas from at least one gas source during a fill cycle, said system having a manifold system, at least one neon tube connector connected to said manifold system by means of a main valve, at least one vacuum pump connected to said manifold system by means of a first pump valve, at least a first gas valve connecting said gas source to said manifold system, a bombarder unit for generating an electrical current and potential across an electrode of said neon tubing for heating said tubing, wherein said process comprises:

sensing the pressure in said manifold system and generating an electrical pressure signal representing said pressure;

sensing the temperature in said neon tubing and generating an electrical temperature signal representing said temperature;

providing an electrical controller for automatically controlling said process which receives said electrical pressure and temperature signals, said controller automatically;

controlling the bombarder current delivered to said tubing during said evacuation cycle to heat said tubing, and increasing said bombarder current in response to said temperature signal reaching a first temperature during said evacuation cycle;

controlling said first pump valve continuously to open and close said first pump valve during said evacuation cycle in response to said pressure signal as said neon tubing is heated to maintain the pressure in said tubing within prescribed conditions;

controlling said first pump valve to automatically open said first pump valve in response to said temperature signal reaching a second temperature greater than said first temperature, and afterwards automatically closing said first pump valve in response to said pressure signal reaching a first pressure;

controlling said gas valve automatically during said fill cycle to open said gas valve in response to said pressure signal reaching a second pressure and said temperature signal reaching a filling temperature less than said second temperature to fill said neon tubing with said gas,and closing said gas valve when the pressure of said gas in said tubing has reach a desired filling pressure; and automatically closing said main valve following closure of said gas valve.

17. The process of claim 16 including providing a diffusion pump and a second pump valve for selectively connecting said diffusion pump in fluid communication with said processing station and tubing, and automatically opening said diffusion pump valve in response to said controller receiving said electrical signal indicating said first pressure and closing said second pump valve in response to said controller receiving said second pressure signal and before said gas valve is open.

18. The process of claim 16 including purging said manifold system of unwanted gases prior to opening said gas valve and backfilling said tubing with said gas.

19. The process of claim 16 providing a source of flush gas connected to said manifold system by means of a flush gas valve, and wherein said process includes opening said flush gas valve and closing said first pump valve in response to said temperature signal reaching a flush gas temperature; and back filling said neon tubing with said flush gas until a predetermined flush gas pressure is reached, and thereafter generating said bombarder current signal to continue to heat said neon tubing.

20. The process of claim 19 including continuously opening and closing said first pump valve to maintain pressure in said neon tubing at below a predetermined pressure level during the heating of said neon tubing; and continuing to heat said flush gas until said second temperature and first pressure are reached.

21. The process of claim 20 including automatically controlling said pump valve to limit said pressure to approximately 1 to 2 torr; and increasing said bombarded current in response to said temperature signal reaching said first temperature to heat said tubing to a desired temperature and remove unwanted gases from said tubing.

22. The process of claim 16 including automatically terminating said bombarder current when said second temperature is reached.

23. The process of claim 16 including opening said gas valve and filling said neon tubing with said gas in response to said second pressure being about one micron or less.

* * * * *